United States Patent [19]

Kindt et al.

[11] Patent Number: 4,607,935

[45] Date of Patent: Aug. 26, 1986

[54] ROLLER TRANSFER APPARATUS

[75] Inventors: Robert J. Kindt, Rochester; Robert M. Peffer, Penfield, both of N.Y.

[73] Assignee: Eastman Kodak Company, Rochester, N.Y.

[21] Appl. No.: 601,480

[22] Filed: Apr. 18, 1984

[51] Int. Cl.[4] ..... G03G 15/00

[52] U.S. Cl. ..... 355/3 TR; 271/900; 271/307; 315/16

[58] Field of Search ..... 355/3 TR, 14 TR; 271/900, 307, 312, 313; 315/16

[56] References Cited

U.S. PATENT DOCUMENTS

| | | | |
|---|---|---|---|
| 3,612,677 | 10/1971 | Langdon et al. . | |
| 3,633,543 | 1/1972 | Pitasi et al. . | |
| 3,644,034 | 2/1972 | Nelson . | |
| 3,702,482 | 11/1972 | Dolcimascolo et al. . | |
| 3,781,105 | 12/1973 | Meagher . | |
| 3,832,055 | 8/1974 | Hamaker . | |
| 3,845,951 | 11/1974 | Hamaker . | |
| 4,066,352 | 1/1978 | Kameda et al. . | |
| 4,106,868 | 8/1978 | Ophey . | |
| 4,302,093 | 11/1981 | Landa . | |
| 4,420,243 | 12/1983 | Baker et al. | 355/3 SH |

FOREIGN PATENT DOCUMENTS

| | | | |
|---|---|---|---|
| 0159561 | 9/1983 | Japan | 355/3 SH |

*Primary Examiner*—A. C. Prescott
*Assistant Examiner*—David Warren
*Attorney, Agent, or Firm*—Lawrence P. Kessler

[57] ABSTRACT

Apparatus for electrostatically transferring a transferable image of electroscopic marking particles from an image-carrying member to a receiver member. The apparatus comprises an electrically conductive member, such as a roller, selectively coupled to a source of electrical image-transferring potential. Such conductive member is adapted to have a receiver member attached to its surface, and includes a mechanism for registering an image-carrying member relative to an attached receiver member. A compliant member, such as a back-up roller having a resilient deformable peripheral surface, engages the conductive member to define an extended nip. An image-carrying member is guided into engagement with the registration mechanism of the conductive member and then through the nip, where a transferable image on such image-carrying member is transferred to such attached receiver member when image-transferring potential is coupled to the conductive member.

10 Claims, 5 Drawing Figures

ROLLER TRANSFER APPARATUS

BACKGROUND OF THE INVENTION

This invention relates generally to transfer apparatus, and more particularly to an electrostatic transfer apparatus including a transfer roller and a compliant back-up roller.

In a typical electrographic process for making reproductions, an electrostatic charge pattern, having an image-wise configuration corresponding to information to be reproduced, is formed on the surface of a grounded dielectric member. The charge pattern is developed by applying electroscopic developer material to such pattern to form a transferable image on the member. The developer material includes, for example, thermoplastic pigmented electroscopic marking particles which are attracted to the charge pattern and held on the member by electrostatic forces. The transferable image is transferred from the dielectric member to a receiver member, and then permanently fixed to such receiver member to form the reproduction.

Transfer is accomplished, for example, by electrostatically charging the receiver member to a level sufficient to attract the developer material from the dielectric member to the receiver member while the receiver member is in contact with the area of the dielectric member carrying the transferable image. Electrical charging of the receiver member is commonly effected by ion emission (for example, from a corona charger) onto a surface of the receiver member, or by contacting the surface of the receiver member opposite the dielectric member with an electrically biased transfer roller.

An electrically biased transfer roller is particularly suitable for use in an electrographic process where multiple related images are sequentially transferred in superimposed relation to a receiver member to form a composite reproduction, such as in making a multicolor reproduction. In such process, the receiver member is attached (tacked) to the transfer roller, and such member is successively returned into registered contact with the related transferable images on the dielectric member for superimposed transfer of such images to the receiver member. Examples of an electrically biased transfer roller are shown in U.S. Pat. No. 3,633,543, issued Jan. 11, 1972, in the name of Pitasi et al, and U.S. Pat. No. 3,832,055, issued Aug. 27, 1974, in the name of Hamaker.

In the above-mentioned patents, the dielectric member is a continuous web. Any adjustments necessary to register successive transferable images on the web with the receiver member to which such images are to be transferred, requires relative movement between the transfer roller (supporting the receiver member) and the web while the two are in contact. Such relative movement can damage the web or the transfer roller. In copending U.S. Pat. No. 4,436,405, issued Mar. 13, 1984, in the name of Kindt, a multi-color reproduction apparatus is described in which the dielectric member is a plurality of discrete sheets on which related transferable images are respectively formed. This apparatus has certain advantages over apparatus utilizing a continuous dielectric web. Specifically, the transport speed of discrete sheets through electrographic process stations can be regulated to optimize the respective functions of such stations, and registration of the transferable images on the discrete sheets relative to the receiver member can be accomplished prior to the two being brought into contact for transfer. However the transfer mechanism described in the above-mentioned Kindt patent, for assuring registration between the successive film sheets bearing related transferable images and the receiver member to which the images are transferred, is complex in nature and provides only a small nip area over which transfer occurs. Such small nip area can lead to incomplete transfer if the time that the image-bearing sheet and the receiver member are in transfer relation is not of sufficient duration.

SUMMARY OF THE INVENTION

This invention is directed to a simplified apparatus for electrostatically transferring a transferable image of electroscopic marking particles from an image-carrying member to a receiver member. The apparatus comprises an electrically conductive member, such as a roller, selectively coupled to a source of electrical image-transferring potential. Such conductive member is adapted to have a receiver member attached to its surface, and includes a mechanism for registering an image-carrying member relative to the attached receiver member. A compliant member, such as a back-up roller having a resilient deformable peripheral surface, engages the conductive member to define an extended nip between the conductive member and compliant member. An image-carrying member is guided into engagement with the registration mechanism of the conductive member and then through the extended nip, where a transferable image on such image-carrying member is transferred to such attached receiver member when image-transferring potential is coupled to the conductive member.

The invention, and its objects and advantages, will become more apparent in the detailed description of the preferred embodiment presented below.

BRIEF DESCRIPTION OF THE DRAWINGS

In the detailed description of the preferred embodiment of the invention reference is made to the accompanying drawings, in which.

DESCRIPTION OF THE PREFERRED EMBODIMENT

Figure 1:
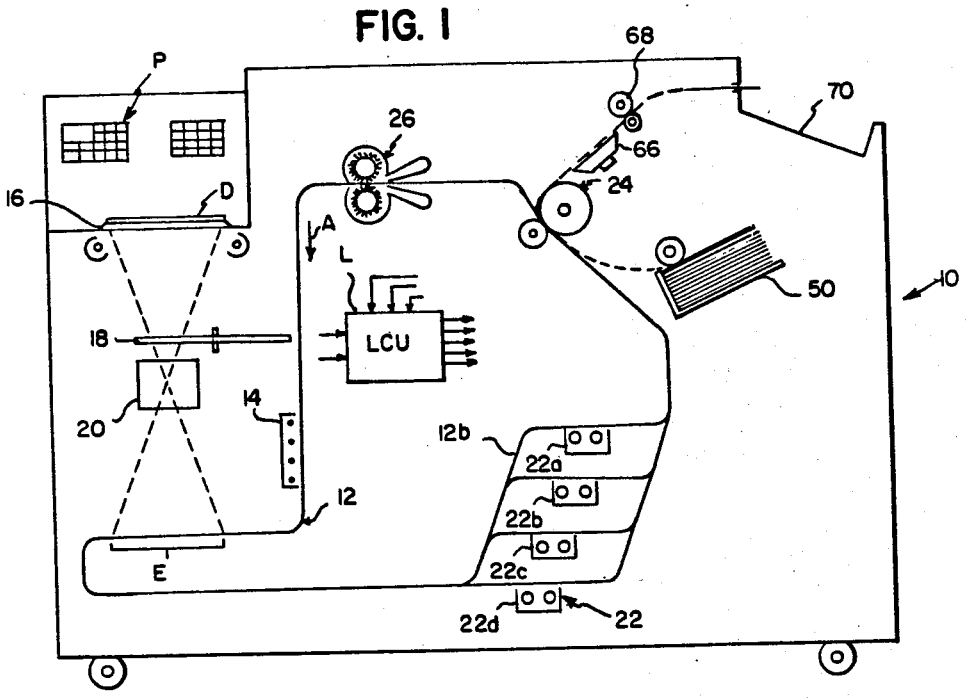
FIG. 1 is a schematic view of an electrographic copier utilizing discrete dielectric film sheets and including a transfer apparatus according to this invention.

Referring now to the accompanying drawings, an electrographic copier, designated generally by the numeral 10, is shown schematically in FIG. 1. The copier 10 includes a track assembly 12 about which image-carrying members are transported seriatim in the direction indicated by arrow A into operative relation with typical electrographic process stations. The image-carrying members are discrete film sheets formed of cut sheets of dielectric material and respectively including a photoconductive layer such as described for example in U.S.

Figure 2:
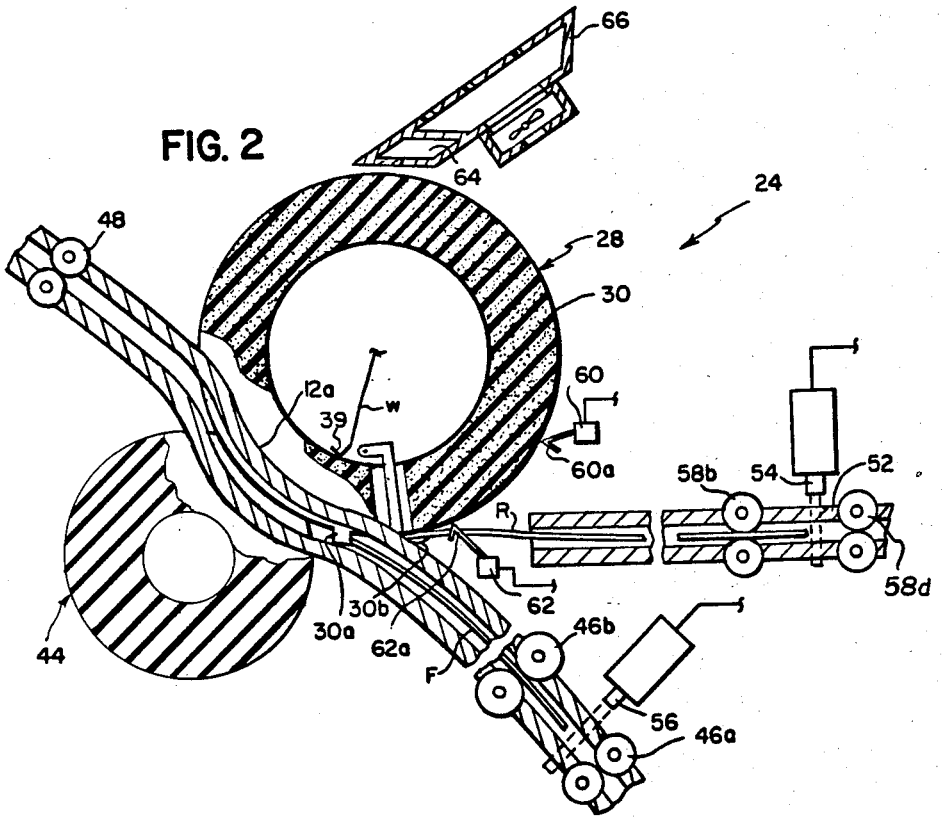
FIG. 2 is a side elevational view, in cross-section and on an enlarged scale, of a portion of the copier of FIG. 1 including the transfer apparatus according to this invention.

Pat. No. 3,615,414, issued Oct. 26, 1971, in the name of Light. The track assembly 12 includes parallel spaced channels supportably engaging opposed marginal edges of the sheets. Transport of the sheets about the track assembly is effected, for example, by drive rollers (e.g. rollers 46*a*, 46*b*, 48 of FIG. 2) engaging such marginal edges of the sheets.

Control of the copier 10 is accomplished by a logic and control unit L including a microprocessor for example. The microprocessor receives operator input signals from an input panel P and timing signals, for example from sensors (not shown) detecting transport of the film sheets about the track assembly 12. Based on such signals and a program for the microprocessor, the unit L produces signals to control the timing of transport of the film sheets about the track assembly and operation of the various electrographic process stations for carrying out the reproduction process. The production of a program for a number of commercially available microprocessors such as INTEL model 8080 or model 8085 microprocessor (which along with others are suitable for use with the invention), is a conventional skill well understood in the art. The particular details of any such program would, of course, depend on the architecture of the designated microprocessor.

In the operation of the copier 10, a discrete dielectric film sheet is transported past a corona charger 14, where it receives a uniform electrostatic charge, to an exposure zone E. In the exposure zone, the charge on the sheet is selectively reduced to form a charge pattern corresponding image-wise to information to be reproduced. In the illustrative embodiment exposure is accomplished by directing a reflected light image from a document D supported on a transparent platen 16 through a filter wheel 18 and a lens 20 to a photoconductive film sheet in the exposure zone E. Of course other optical or electrical arrangements for forming a charge pattern on the film sheet are suitable for use with this invention. After a charge pattern is formed on the film sheet, the sheet is transported through a development station 22 where the pattern is developed by electrostatically adhering pigmented electroscopic marking particles to the pattern to form a transferable image on such sheet. The film sheet bearing a transferable image is then transported through a transfer apparatus 24 where the image is transferred to a receiver sheet in the manner to be described hereinbelow. After transfer, the film sheet is transported through a cleaning station 26, where any residual marking particles are removed, and returned to the vicinity of the charger 14 for reuse.

For each monochromatic reproduction to be made, one reflected light image of the document is passed through a neutral density sector of the filter wheel 18 to expose one film sheet. The charge pattern formed on the film sheet by such exposure is developed in station 22 to form the transferable image. On the other hand, for each multicolor reproduction to be made, a plurality of reflected light images of the document are successively passed through different color sectors of the filter wheel to expose a plurality of film sheets respectively. With a subtraction color reproduction process, the color sectors are of primary colors. The charge patterns formed on the film sheets by such exposures are respectively developed with complementary colored toners to form transferable images. Development of such images is accomplished by directing the image-carrying film sheets through branched portion 12*b* of the track assembly 12 respectively, into operative association with magnetic brush developers 22*a*–22*c*, for example, of development station 22. The developers 22*a*–22*c* contain marking particles of a respective color corresponding to the complement of a primary color. Film sheets exposed to a certain primary color are then directed into association with the developer containing particles of the color complementary to that color. Of course a fourth magnetic brush developer 22*d* containing black marking particles may be used to develop a related image exposed on a film sheet through a neutral density filter sector.

Figure 3:
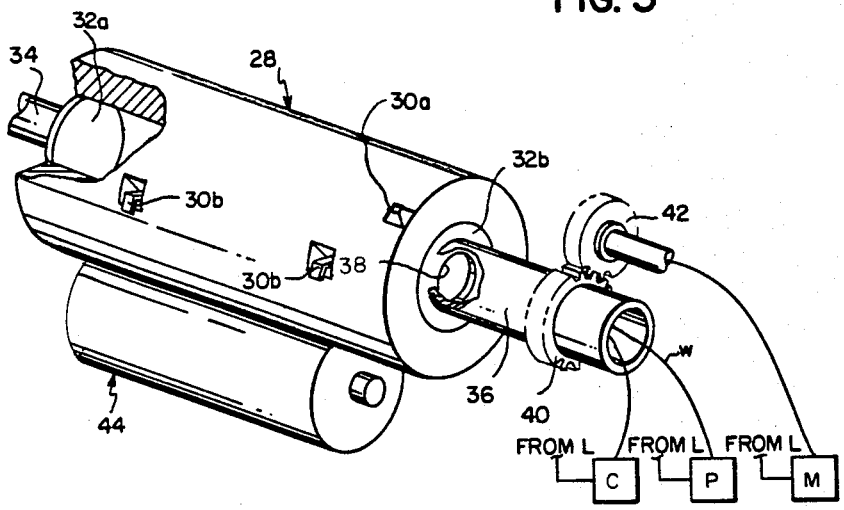
FIG. 3 is a view, in perspective, of the transfer apparatus with portions broken away or removed to facilitate viewing.

The transfer apparatus 24 (best shown in FIGS. 2 and 3), according to this invention, includes a transfer roller 28 and a back-up roller 44. The transfer roller 28 comprises a hollow cylinder 30 formed of electrically conductive material, such as carbon loaded silicone rubber or urethane containing a conducting agent for example, closed by insulative end caps 32*a*, 32*b*. If required for longitudinal rigidity, the cylinder may be supported on a conductive metal tube (not shown). The cylinder 30 has integral film sheet registration pins 30*a* (one shown) extending substantially radially above the peripheral surface of the cylinder and aligned on an element of the cylinder. Further, the transfer roller 28 has clamps 30*b* spaced from the end caps 32*a*, 32*b* and located along an element of the cylinder 30 inwardly with respect to the pins 30*a*. The clamps secure the lead edge of a receiver sheet to the peripheral surface of the cylinder 30 in a well known manner such as by a solenoid actuated linkage mechanism shown in U.S. Pat. No. 3,612,677, issued Oct. 12, 1981, in the name of Langdon et al for example. Of course other suitable clamping means, such as a cam actuated clamp (see U.S. Pat. No. 3,702,482, issued Nov. 7, 1972, in the name of Dolcimascolo et al), or vacuum (see U.S. Pat. No. 3,845,951, issued Nov. 5, 1974 in the name of Hamaker) could be employed.

Figure 4:
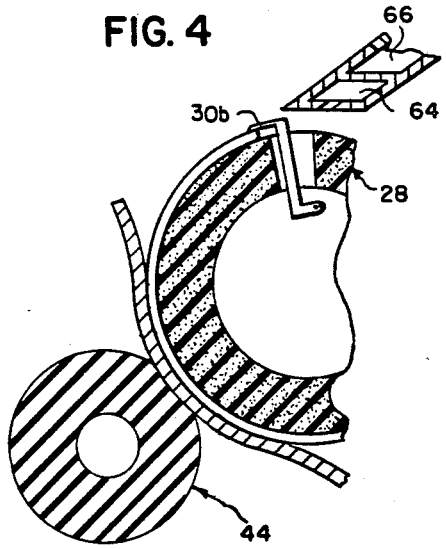
FIGS. 4 and 5 are cross-sectional side elevational views similar to FIG. 2, with portions removed to facilitate viewing, taken at different times in the operation of the transfer apparatus according to this invention.
Figure 5:
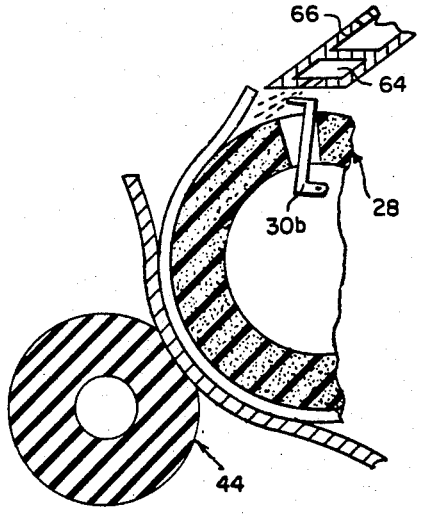

A stub shaft 34 and a drive shaft 36 are respectively coupled to and extend outwardly from the end caps 32*a*, 32*b*. The longitudinal axes of shafts 34 and 36 are coincident with the longitudinal axis of the roller 28. The shafts 34, 36 are supported within the copier 10 in bearings (not shown) to enable the transfer roller 28 to rotate about its longitudinal axis. Shaft 36 is hollow and communicates with an opening 38 in end cap 32*b*. A motive source C (such as a solenoid activating electrical potential) for selectively actuating the clamps 30*b* communicates with the interior of the cylinder 30 through the hollow shaft 36 and end cap opening 38. An electrical potential source P for effecting transfer in the manner explained hereinbelow is coupled to the interior surface of the cylinder 30 by a wire W passing through the shaft 36 and end cap opening 38 and connected to a conventional wiper contact 39. A gear 40 mounted on the shaft 36 meshes with a pinion gear 42 operatively coupled to motor M. Actuation of the motor in response to signals from the unit L rotates the transfer roller 28 about its longitudinal axis (in a clockwise direction in FIGS. 2, 4, and 5).

The back-up roller 44 comprises a cylinder formed of a compliant material such as resiliently deformable rubber or polyurethane foam for example. If required for longitudinal rigidity, the cylinder may be mounted on a metal tube (not shown). The dimension of the roller 44 along its longitudinal axis is less than the dimension of transfer roller 28 along its longitudinal axis. The roller 44 is rotatably supported in the copier 10 with its longitudinal axis parallel to the longitudinal axis of transfer roller 28 and spaced along its axis to lie between pins 30*a* (see FIG. 3). The spacing between the longitudinal axes of the transfer roller 28 and the back-up roller 44 is set at a distance less than the sum of the radii of the rollers. Accordingly, due to the compliant nature of the material forming the roller 44, an extended nip area is established between the rollers. The extended nip area provides for an increased zone over which a film sheet and receiver sheet are in contact. By increasing the zone over which the sheets are in contact, the area over which transfer occurs and drive is effected is increased.

The portion of the track assembly 12 adjacent to the transfer apparatus 24 includes curved channel segments 12*a* (one shown in FIG. 2) in juxtaposition with the ends of the cylinder 30. The radius of curvature to the center of the path between the curved segments is substantially equal to the radius of the transfer roller 28, and the path is aligned with the extended nip area between the rollers 28 and 44. The length of the segments, in the direction of travel of a film sheet in the track assembly, is at least equal to the dimension of the extended nip in the same direction. Thus, a film sheet transported along the track assembly 12 is guided by the segments 12*a* through the extended nip area.

The transfer apparatus 24, under the control of unit L, functions in timed relation with remainder of the electrographic process stations of the copier 10 and operates as follows: As an exposed film sheet is being transported about the track assembly 12 through station 22 for development, the potential source P is operatively coupled to the transfer roller 28 to apply a transfer potential to cylinder 30, and the motor M is turned on to rotate the transfer roller. Substantially simultaneously a receiver sheet is fed from a supply hopper 50 (see FIG. 1) toward the transfer roller 28. The receiver sheet (designated by the letter R in FIG. 2) is guided by a track 52 similar to track assembly 12 for example.

A registration mechanism, such as a solenoid actuated pin 54, is selectively extended (broken line position of FIG. 2) to intercept the guide track 52 and block transport of the receiver sheet. Similarly a registration mechanism, such as a solenoid actuated pin 56, is selectively extended (broken line position of FIG. 2) to intercept track assembly 12 and b1ock transport of a transferable image-carrying film sheet (designated by the letter F in FIG. 2). Then, in a predetermined timed relation the pins 54 and 56 are respectively retracted (to solid line positions of FIG. 2) to release the receiver sheet and film sheet for transport respectively by drive rollers 58*a*, 58*b* and 46*a*, 46*b* into the nip between rollers 28 and 44.

Timing of the retraction of pins 54 and 56 is set so that receiver sheet R and film sheet F arrive in a desired predetermined relationship at the nip between rollers 28 and 44; i.e., the receiver sheet is registered with relation to the area of the film sheet bearing the transferable image. Such timing is accomplished in the following manner. Switches 60 and 62, located adjacent to the peripheral surface of cylinder 30 at one end of the transfer roller 28, have armatures 60*a* and 62*a* respectively lying in the path of a pin 30*a*. When the pin 30*a* sequentially contacts the armatures 60*a* and 62*a*, the switches are actuated and appropriate signals are transmitted to the unit L. In response to the signal transmitted on actuation of switch 60, the unit L produces signals to actuate the solenoid to retract pin 54 enabling the receiver sheet to be fed by drive rollers 58*a*, 58*b* toward the transfer roller 28 and subsequently to activate source C to actuate the clamps 30*b* to secure the lead edge of such sheet to the transfer roller. In response to the signal transmitted on actuation of switch 62, the unit L produces a signal to actuate the solenoid to retract pin 56 enabling the film sheet to be fed by drive rollers 46*a*, 46*b* toward the nip.

The peripheral speed of the drive roller 58*b* is selected to transport the receiver sheet into contact with the clamps 30*b* at a speed greater than the angular speed of the clamps. The receiver sheet is accordingly overdriven into positive contact with the clamps and is positively registered by the clamps to the transfer roller 28. The receiver sheet is thus registered on the peripheral surface of the cylinder 30 with the lead edge of the receiver sheet being a predetermined distance from the pins 30*a*. Of course, the cylinder 30 may alternatively have an additional set of pins similar to pins 30*a* (or any other suitable registration mechanism) located to form a registration stop for the lead edge of the receiver sheet.

Meanwhile, the peripheral speed of the drive roller 46*b* is selected to transport the film sheet into contact with the pins 30*a* of the transfer roller 28 as the pins are rotated to an angular position immediately upstream of the nip between the transfer rollers 28 and the back-up roller 44. The speed of the film sheet is greater than the angular speed of the pins so that the film sheet is overdriven into positive contact with the pins and is positively registered by the pins on the peripheral surface of the cylinder 30. Therefore, the film sheet and the receiver sheet have the desired predetermined registered relationship as they are transported through the nip. In this manner an image transferred from a film sheet to a receiver sheet has a desired orientation on such receiver sheet.

As the film sheet F and receiver sheet R enter the nip, they leave the influence of their respective drive rollers 46*b* and 58*b*. Thus, transport through the nip is effected only by the engagement between the transfer roller 28 and compliant back-up roller 44. This assures that the sheets move together in the nip without slippage relative to one another. Further, the potential source P coupled to the cylinder 30 establishes an electrical field between the cylinder and the grounded film sheet. The magnitude of the potential source is selected so that the electrical field strength is sufficient to effect electrostatic transfer of the transferable image on the film sheet to the receiver sheet.

As noted above, due to the compliant nature of the material of the back-up roller 44, the nip area is extended. Such extended nip area increases the time the film sheet and receiver sheet are in transfer relation (under the influence of the electrical field) to improve the effectiveness of the transfer process over that where the back-up roller is not compliant and a minimal nip area exists between the back-up and transfer rollers. Moreover the extended nip area improves control of the transport of the film sheet/receiver sheet by increasing the surface area over which they are engaged. Furthermore, the fact that the back-up roller is compliant, rather than the transfer roller, establishes a uniform travel path for the receiver sheet relative to the rotational axis of the transfer roller 28. The receiver sheet therefore travels at a substantially uniform velocity through the nip.

The film sheet is guided by the track assembly out of the nip area in a manner which assures positive detack of the film sheet from the receiver sheet. That is, the connection of curved segments 12*a* with the remainder of the track assembly 12 downstream of the transfer roller 28 directs the transported film sheet away from the transfer roller and tacked receiver sheet (see FIGS. 4 and 5). In the monochromatic reproduction process when the receiver sheet leaves the nip after initiation of transfer of the image from a film sheet, the clamps 30*b* are deactuated to release the lead edge of the receiver sheet and a separator mechanism 64 is activated to detack such sheet from the peripheral surface of cylinder 30 of the transfer roller 28 (see FIG. 5). The separator mechanism is, for example, an air puffer which urges the lead edge receiver sheet from the cylinder 30. The beam strength of the receiver sheet leaving the cylinder causes the sheet to move into engagement with a vacuum transport 66. Of course, other separator mechanisms, such as a detack corona or stripper fingers, are suitable for use with this invention. The transport 66 delivers the receiver sheet to a fusing assembly 68 (FIG. 1) where the transferred image is fixed to the sheet by heat and/or pressure for example. After fixing the receiver sheet is delivered to an exit hopper 70 for operator retrieval of the finished reproduction.

When a plurality of images from a plurality of film sheets respectively are to be transferred to a single receiver sheet, such as in making a multicolor reproduction (or a composite monochrome reproduction) for example, the receiver sheet remains secured to the cylinder 30 after detack of the first film sheet. Since the receiver sheet remains in its secured condition on the transfer roller 28, the relationship of the lead edge of the receiver sheet to the pins 30*a* does not change. Therefore, when subsequent film sheets respectively carrying related transferable images are transported toward the transfer roller 28 and engage pins 30*a* (in a similar manner to that disclosed above), they are registered relative to the receiver sheet as it is successively returned to the nip between rollers 28 and 44. The subsequent film sheets thus assume the same registered relationship with respect to the receiver sheet as did the first film sheet. Accordingly, respective image transfers from subsequent film sheets to the receiver sheet occur in accurate superimposed register to form a faithful multicolor (or composite monochrome) reproduction on the receiver sheet. The release of the lead edge and detack of the receiver sheet to which a plurality of related images have been transferred from a plurality of film sheets respectively is effected by deactuation of the clamps 30*b* and by the separator mechanism 64 in a manner similar to that described above. Such release and detack occurs when the receiver sheet leaves the nip after initiation of transfer of the image from the last of such plurality of film sheets.

The invention has been described in detail with particular reference to a preferred embodiment thereof, but it will be understood that variations and modifications can be effected within the spirit and scope of the invention.

I claim:

1. Apparatus for electrostatically transferring at least one transferable image of electroscopic marking particles from an image-carrying member to a registered receiver member, said apparatus comprising:

electrically conductive means, selectively coupled to a source of electrical image-transferring potential, for effecting transfer of an image from an image-carrying member to a receiver member, said electrically conductive means including means for attaching a receiver member thereto and means for registering an image-carrying member relative to an attached receiver member;

compliant means for engaging said conductive means over an extended contact area to establish an effective transfer zone between said conductive means and said compliant means; and guide means, located adjacent to such extended contact area, for directing an image-carrying member into engagement with said registration means of said conductive means and then through such contact area between said conductive means and said compliant means, whereby in such extended contact area a transferable image on such image-carrying member is transferred to such attached receiver member when image-transferring potential is coupled to said conductive means.

2. The invention of claim 1 wherein said conductive means is a roller, and said compliant means is a back-up roller having a resiliently deformable peripheral surface, said back-up roller being mounted relative to said first mentioned roller with the resiliently deformable peripheral surface engaging and conforming to a portion of the peripheral surface of such first mentioned roller to establish an extended nip area.

3. The invention of claim 2 wherein said first mentioned roller is a hollow cylinder closed on opposite ends to form an interior chamber, and said means for attaching a receiver member includes selectively actuated clamps for securing a receiver sheet to the peripheral surface of said cylinder.

4. The invention of claim 1 wherein said guide means is configured for directing an image-carrying member out of engagement with said registration means after such contact area to effect detack of said image-carrying member from said receiver member.

5. The invention of claim 1 wherein said guide means includes means for engaging an image-carrying member and establishing a path for such member leading to the extended contact area, through such area, and exiting from such area.

6. Apparatus for electrostatically transferring at least one transferable image of electroscopic marking particles from a discrete image-carrying member to a registered receiver member, said apparatus comprising:

an electrically conductive roller, selectively coupled to a source of electrical image-transferring potential for effecting transfer of an image from a discrete image-carrying member to a receiver member, said roller including means for attaching a receiver member to the peripheral surface thereof and means extending substantially radially from such peripheral surface for registering a discrete image-carrying member relative to an attached receiver member;

compliant means for engaging said conductive roller over an extended contact area to establish an effective transfer zone between said conductive roller and said compliant means; and guide means, located adjacent to such extended contact area, for directing a discrete image-carrying member into engagement with said registration means of said conductive roller and then through such contact area between said conductive roller and said compliant means, whereby in such extended contact area a transferable image on such image-carrying member is transferred to such attached receiver member when image-transferring potential is coupled to said conductive roller.

7. The invention of claim 6 wherein said compliant means is a back-up roller having a resiliently deformable peripheral surface, said back-up roller being mounted relative to said first mentioned roller with the resiliently deformable peripheral surface engaging and conforming to a portion of the peripheral surface of such first mentioned roller to establish an extended nip area.

8. The invention of claim 6 wherein said roller is a hollow cylinder closed on opposite ends to form an interior chamber, and said means for attaching a receiver member includes selectively actuated clamps for securing a receiver member to the peripheral surface of said cylinder.

9. The invention of claim 8 wherein said apparatus further includes means for selectively detacking such receiver member from the peripheral surface of said cylinder after transfer of a desired number of transferable images from respective discrete image-carrying members to such receiver member.

10. The invention of claim 6 wherein said guide means includes means for engaging a discrete image-carrying member and establishing a path for such member leading to the extended contact area, through such area, and exiting from such area.

* * * * *